US008288940B2

(12) United States Patent
Hehenberger

(10) Patent No.: US 8,288,940 B2
(45) Date of Patent: Oct. 16, 2012

(54) LAMINATE REFLECTIVE AND ELECTROLUMINESCENT ARTICLE

(75) Inventor: Rodney K. Hehenberger, Lake Elmo, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 113 days.

(21) Appl. No.: 12/710,628

(22) Filed: Feb. 23, 2010

(65) Prior Publication Data

US 2010/0231113 A1 Sep. 16, 2010

Related U.S. Application Data

(60) Provisional application No. 61/159,539, filed on Mar. 12, 2009.

(51) Int. Cl.
*H05B 33/00* (2006.01)
*H05B 33/02* (2006.01)
*H01J 9/00* (2006.01)

(52) U.S. Cl. ..... 313/506; 313/1; 313/498; 313/509; 313/510; 313/517; 445/24; 362/84; 428/131; 428/137

(58) Field of Classification Search ..... 313/506, 313/509; 362/84, 108; 445/24
See application file for complete search history.

(56) References Cited

U.S. PATENT DOCUMENTS

| | | | | |
|---|---|---|---|---|
| 3,758,192 | A | 9/1973 | Bingham | |
| 4,684,353 | A | 8/1987 | deSouza | |
| 4,983,436 | A * | 1/1991 | Bailey et al. | 428/40.4 |
| D314,673 | S | 2/1991 | Legare | |
| 4,999,936 | A | 3/1991 | Calamia et al. | |
| 5,237,448 | A | 8/1993 | Spencer et al. | |
| 5,272,562 | A | 12/1993 | Coderre | |
| 5,315,491 | A | 5/1994 | Spencer | |
| 5,567,040 | A | 10/1996 | Tabanera | |
| 5,570,945 | A | 11/1996 | Chien et al. | |
| 5,770,124 | A | 6/1998 | Marecki | |
| 5,856,029 | A | 1/1999 | Burrows | |
| 5,856,030 | A | 1/1999 | Burrows | |
| 5,980,976 | A | 11/1999 | Burrows | |
| 5,981,032 | A | 11/1999 | Smith et al. | |
| 6,086,213 | A | 7/2000 | Holce | |
| 6,142,643 | A | 11/2000 | Araki | |

(Continued)

FOREIGN PATENT DOCUMENTS

CA 2 487 264 A1 11/2004

(Continued)

OTHER PUBLICATIONS

English translation of WO 2008/142012 to Werners et al.published Nov. 27, 2008.*

(Continued)

*Primary Examiner* — Sikha Roy
(74) *Attorney, Agent, or Firm* — Nicole J. Einerson

(57) ABSTRACT

An electroluminescent article is described, wherein the article includes one or more electroluminescent structures, which may in some embodiments be discontinuous from each other. The article further includes one or more retroreflective structures and, optionally, a removable carrier film disposed over the electroluminescent structures and the retroreflective structures. In some embodiments, the retroreflective structures may be disposed at least partially in the light path capable of being emitted by one or more of the electroluminescent structures. Exemplary articles may, optionally, include connectors between electroluminescent structures that comprise conductive adhesive. Exemplary articles according to the present disclosure may be disposed in roll form. The present disclosure also includes methods for making such articles.

19 Claims, 4 Drawing Sheets

U.S. PATENT DOCUMENTS

| | | | | |
|---|---|---|---|---|
| 6,146,006 | A | 11/2000 | Cross | |
| 6,261,633 | B1 | 7/2001 | Burrows | |
| D446,945 | S | 8/2001 | Jacobs | |
| 6,270,834 | B1 | 8/2001 | Burrows | |
| 6,309,764 | B1 | 10/2001 | Burrows | |
| 6,551,726 | B1 | 4/2003 | Burrows | |
| 6,696,786 | B2 | 2/2004 | Burrows | |
| 6,717,361 | B2 | 4/2004 | Burrows | |
| 6,769,138 | B2 | 8/2004 | Golle et al. | |
| 6,859,941 | B2 | 3/2005 | Koppes | |
| 6,931,665 | B2 | 8/2005 | Feduzi et al. | |
| 6,964,493 | B1 | 11/2005 | Whitlock | |
| 6,974,610 | B1 | 12/2005 | Koppes | |
| 7,107,622 | B2 | 9/2006 | Feduzi et al. | |
| 7,144,127 | B2 | 12/2006 | Golle et al. | |
| 7,147,339 | B2 | 12/2006 | Golle et al. | |
| 7,156,528 | B2 | 1/2007 | Weiss et al. | |
| 7,220,011 | B2 | 5/2007 | Hurwitz | |
| 7,229,183 | B2 | 6/2007 | Golle et al. | |
| 7,229,184 | B2 | 6/2007 | Golle et al. | |
| 7,281,813 | B2 | 10/2007 | Golle et al. | |
| D587,907 | S | 3/2009 | Vandenberg | |
| D587,908 | S | 3/2009 | Carlson | |
| D587,909 | S | 3/2009 | Carlson | |
| D594,663 | S | 6/2009 | Vandenberg | |
| D594,664 | S | 6/2009 | Otte | |
| 7,600,269 | B2 | 10/2009 | Feduzi | |
| D613,073 | S | 4/2010 | Hehenberger | |
| 8,015,620 | B2 | 9/2011 | Feduzi | |
| 2002/0141060 | A1 | 10/2002 | Lu et al. | |
| 2003/0150043 | A1 | 8/2003 | Koppes | |
| 2005/0157390 | A1* | 7/2005 | Weiss et al. | 359/529 |
| 2006/0011287 | A1* | 1/2006 | Carlson et al. | 156/230 |
| 2006/0034064 | A1 | 2/2006 | Kanzler | |
| 2006/0044651 | A1* | 3/2006 | Mimura | 359/529 |
| 2006/0092625 | A1 | 5/2006 | McKowen | |
| 2006/0143772 | A1 | 7/2006 | Feduzi | |
| 2006/0291194 | A1 | 12/2006 | Golle et al. | |
| 2007/0056077 | A1 | 3/2007 | Feduzi | |
| 2009/0021831 | A1 | 1/2009 | Bacon, Jr. et al. | |
| 2010/0177517 | A1 | 7/2010 | Foley | |
| 2010/0202143 | A1 | 8/2010 | Ruehlemann | |
| 2011/0300348 | A1 | 12/2011 | Feduzi | |

FOREIGN PATENT DOCUMENTS

| | | | |
|---|---|---|---|
| DE | 20313630 | U1 | 9/2003 |
| DE | 202004011734 | U1 | 9/2003 |
| EP | 0 166 534 | A1 | 1/1986 |
| EP | 0 648 436 | A1 | 4/1995 |
| EP | 1 084 633 | A1 | 3/2001 |
| EP | 0594089 | | 6/2001 |
| EP | 0896683 | | 6/2001 |
| EP | 1127984 | | 8/2001 |
| EP | 0 759 179 | B1 | 11/2001 |
| FR | 2 896 608 | | 1/2006 |
| GB | 1038469 | | 8/1966 |
| GB | 1424754 | | 2/1976 |
| GB | 2 408 915 | A | 6/2005 |
| GB | 2466027 | | 6/2010 |
| JP | 2005-077445 | | 3/2005 |
| JP | 2005-077448 | | 3/2005 |
| JP | 2006-228455 | | 8/2006 |
| WO | WO 91/18374 | | 11/1991 |
| WO | WO 94/25666 | | 11/1994 |
| WO | WO 98/20279 | | 5/1998 |
| WO | WO 98/20375 | A1 | 5/1998 |
| WO | WO 98/58281 | | 12/1998 |
| WO | WO 01/49941 | A2 | 7/2001 |
| WO | WO 03/007740 | A2 | 1/2003 |
| WO | WO 2004/100111 | | 11/2004 |
| WO | WO 2006/129246 | | 12/2006 |
| WO | WO 2007/065227 | | 6/2007 |
| WO | WO 2007/092152 | | 8/2007 |
| WO | 2008/142012 | A1 | 11/2008 |
| WO | WO 2008/142012 | | 11/2008 |

OTHER PUBLICATIONS

M 96 10 334 and M 97 00 908 DE Taste Sample Sheet Folder 13 of 0/10/1997, *Retro Reflecting Films for Speedometer Glass Lenses of the Type* 1, 2, 3.

Search Report dated Jun. 2, 2010 from International Application No. PCT/US2010/025030.

US D571,107, 06/2008, Otte et al. (withdrawn)

* cited by examiner

LAMINATE REFLECTIVE AND ELECTROLUMINESCENT ARTICLE

CROSS-REFERENCE TO RELATED APPLICATION

This application claims the benefit of U.S. Provisional Patent Application No. 61/159,539 filed Mar. 12, 2009.

FIELD OF DISCLOSURE

The present disclosure pertains to an article including at least one electroluminescent structure used in combination with one or more retroreflective structures. More particularly, the present disclosure pertains to laminate articles including both at least one electroluminescent structure and at least one retroreflective structure.

BACKGROUND

Electroluminescent lighting is commonly used in applications requiring light weight and low power illumination. Electroluminescent lamps are typically made of a layer of phosphor and a layer of dielectric disposed between two layers of electrodes where one electrode layer is transparent or translucent, allowing light to shine through it when the lamp is powered. Applications for electroluminescent lighting range from lighting for displays to conspicuity lighting for garments. When electroluminescent lamps are used for garments, they can provide a good source of light in dark environments to increase the visibility of individuals wearing the garments.

Retroreflective materials are also commonly used for a variety of applications including road signs, footwear, vests, and other garments. Retroreflective materials can be created in a variety of ways, including using a layer of glass beads, a specular reflective agent disposed under the beads and a binder below the specular reflector. When incident light enters the bead, the bead focuses the light on the specular reflector. The specular reflector forces the light back through the bead so that it exits in a generally opposite direction of the incident light at about the same angle. This process of reflecting light back in the general direction of its source is commonly referred to as retroreflection. Retroreflective lighting is an excellent source of conspicuity in the dark when headlights or other incident light is reflected off of the retroreflective materials.

Electroluminescent lighting and retroreflective materials can be disposed on or attached to garments and other end-use articles through a variety of methods. There remains a need for materials that provide increased and/or improved conspicuity to their users and various articles under a variety of conditions, and that can be easily and effectively used in manufacture of various garments and end-use articles.

SUMMARY

In one aspect, the present disclosure is directed toward a laminate electroluminescent and retroreflective article including an electroluminescent structure and a retroreflective structure. The electroluminescent structure includes an electrode layer, a phosphor layer disposed over the electrode layer and a transparent electrode layer disposed over the phosphor layer. A removable carrier film is disposed over the retroreflective structure and the electroluminescent structure.

In another aspect, the present disclosure is directed to a laminate electroluminescent and retroreflective article including a plurality of electroluminescent structures and a retroreflective structure. Each electroluminescent structure includes an electrode layer, a phosphor layer disposed over the electrode layer and a transparent electrode layer disposed over the phosphor layer. The retroreflective structure can be disposed over the electroluminescent structure and at least partially in a path of light capable of being emitted by the electroluminescent structure. At least one connector including conductive adhesive electrically connects at least two of the electroluminescent structures.

In another aspect, the present disclosure is directed toward a laminate electroluminescent and retroreflective article including an electroluminescent structure and a retroreflective structure. The electroluminescent structure includes an electrode layer, a phosphor layer disposed over the electrode layer and a transparent electrode layer disposed over the phosphor layer. The article is disposed in roll form.

In another aspect, the present disclosure is directed toward a laminate electroluminescent and retroreflective article including an electroluminescent structure and a retroreflective structure. The electroluminescent structure includes an electrode layer, a phosphor layer disposed over the electrode layer and a transparent electrode layer disposed over the phosphor layer. At least one connector electrically connects at least two of the electroluminescent structures, and at least two of the electroluminescent structures are discontinuous.

In yet another aspect, the present disclosure is directed toward a method of making a laminate electroluminescent and retroreflective article. The method includes providing a retroreflective structure attached to a removable carrier film and disposing an electroluminescent structure on a side of the retroreflective structure that is opposite to the removable carrier film. The electroluminescent structure includes an electrode layer, a phosphor layer disposed over the electrode layer and a transparent electrode layer disposed over the phosphor layer.

BRIEF DESCRIPTION OF THE DRAWINGS

The invention may be more completely understood in consideration of the following detailed description of various embodiments of the invention in connection with the accompanying drawing, in which.

The figures are not necessarily to scale. Like numbers used in the figures refer to like components. However, it will be understood that the use of a number to refer to a component in a given figure is not intended to limit the component in another figure labeled with the same number.

DETAILED DESCRIPTION

The present disclosure provides a laminate reflective and electroluminescent article that can result in improved conspicuity for a variety of materials in a variety of lighting conditions, including both dusk and dark. A laminate reflective and electroluminescent article initially removably attached to a carrier film and/or provided in a roll form consistent with the present disclosure can be efficiently and conveniently disposed on a variety of garments or other articles. A laminate reflective and electroluminescent article of the present disclosure can increase ease of shipping and storage and improve manufacturing efficiency for conspicuity garments and other articles. Additionally, because of a laminate reflective and electroluminescent article's ability to be flexible, thin and light, it can be disposed on a greater variety of articles, including but not limited to, lightweight materials, such as the materials used for tee shirts.

Figure 1:
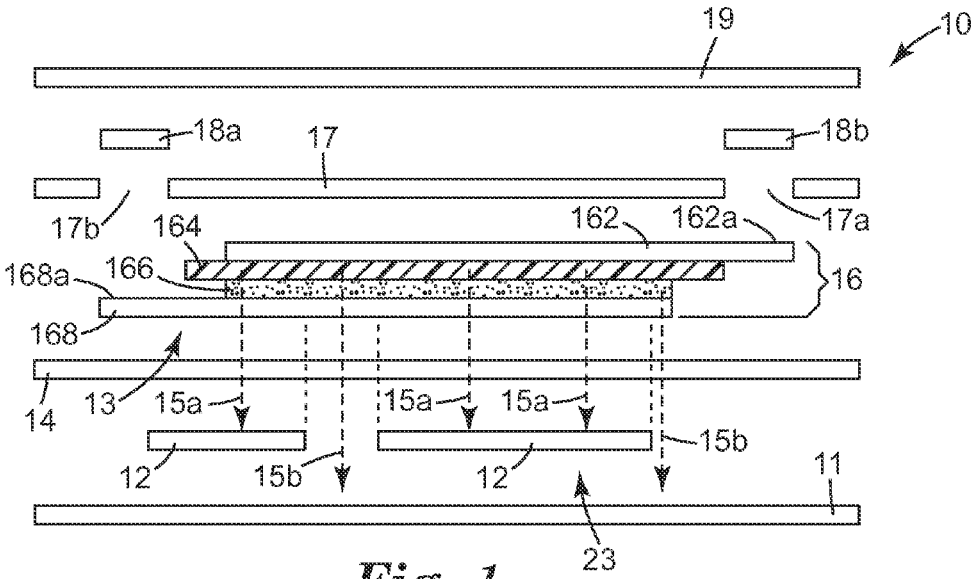
FIG. 1 shows an exploded cross-sectional view of an exemplary laminate reflective and electroluminescent article.

FIG. 1 shows an exploded cross sectional view of an exemplary laminate reflective and electroluminescent article 10. The exemplary article 10 can include a removable carrier film 11. Retroreflective structure 12 can be disposed over the carrier film 11 such that the reflective sides face the carrier film 11 and away from an electroluminescent structure 16. The retroreflective structure may be continuous or discontinuous (including two or more disconnected segments), as further explained below. A protective layer 14 can be disposed between electroluminescent structure 16 and retroreflective structure 12. A second protective layer 17 can be disposed over the electroluminescent structure 16. Protective layer 17 can alternatively be disposed between conductors 18*a* and 18*b* and adhesive 19 or in any other appropriate location. Adhesive 19 can be used to secure the adjacent components of the laminate reflective and electroluminescent article 10, such as one or more of conductors 18*a*, 18*b*, electroluminescent structure 16 and protective layer 17 to each other or to an end-use article. For the purposes of the present disclosure, the term "laminate" shall mean that the structure is composed of layers of firmly attached materials and shall not be indicative of the process by which the structure is made or the layers are attached.

The carrier film 11 is preferably constructed so that it can lend structural integrity to the laminate article for as long as desired but can also be peeled away from the laminate article at a desired time. Carrier film 11 can have any suitable construction, such as a single-layer or a multi-layer construction. Carrier film 11 can additionally include any appropriate means for attaching a laminate reflective and electroluminescent article to it, for example, tape. Carrier film 11 may in some embodiments include a non-woven web or a woven material. The carrier film 11 may be made of any suitable material or materials. For example, carrier film 11 can be made of any suitable polymeric material or materials including polyesters, such as polyethylene terephthalate, polyolefins such as polyethylene and polypropylene, and polyurethanes or any other appropriate material, such as fabric or paper.

In some exemplary embodiments, the removable carrier film 11 can be one of the outermost layers of the laminate article 10 during at least a portion of its useful life. Thus, for at least a certain period of time (e.g., during shipping, storage and at least some manufacturing steps), carrier film 11 can serve as base upon which other layers and components of an exemplary laminate reflective and electroluminescent article can be disposed. In accordance with the present disclosure, carrier film 11 can be removed from other layers of the laminate article, before, after or at the time the article is disposed on an end-use article, such as a garment. When other layers and/or components are disposed on carrier film 11, they can be disposed so that the light reflecting side of the retroreflective structure 12 and light emitting side of the electroluminescent article 16 face the carrier film 11. When such an exemplary laminate reflective and electroluminescent article is secured to a support, which may be a garment or another end-use article, the orientation is reversed and carrier film 11 can be removed to reveal the light reflecting and light emitting sides of the electroluminescent 16 and retroreflective structures 12 on an outer surface of a garment or another article.

Figure 5:
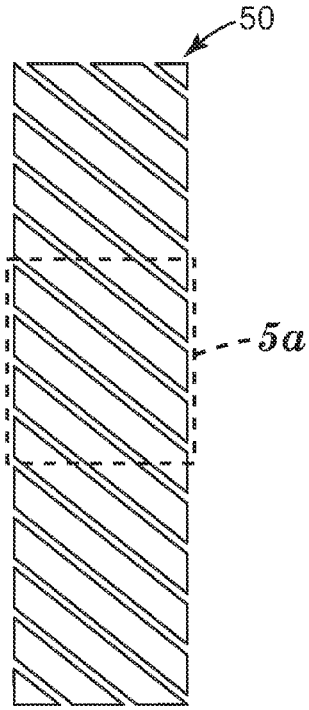
FIGS. 5 and 5A show an example of a pattern of discontinuous retroreflective segments defining retroreflective and non-retroreflective regions.
Figure 6A:
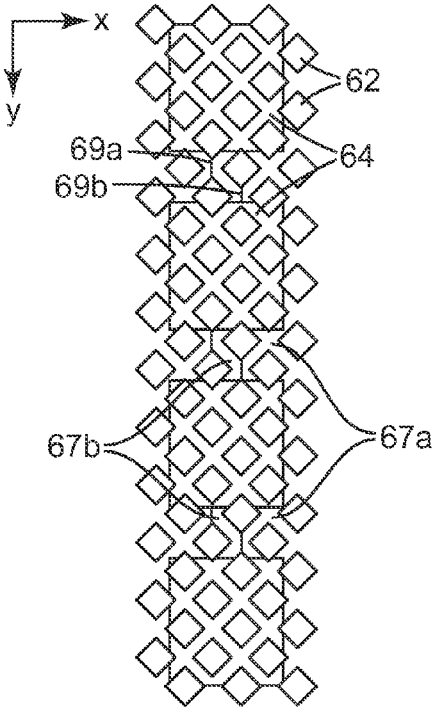
FIG. 6A shows an exemplary pattern of discontinuous electroluminescent structures and discontinuous retroreflective segments configured in a two-dimensional array.
Figure 6B:
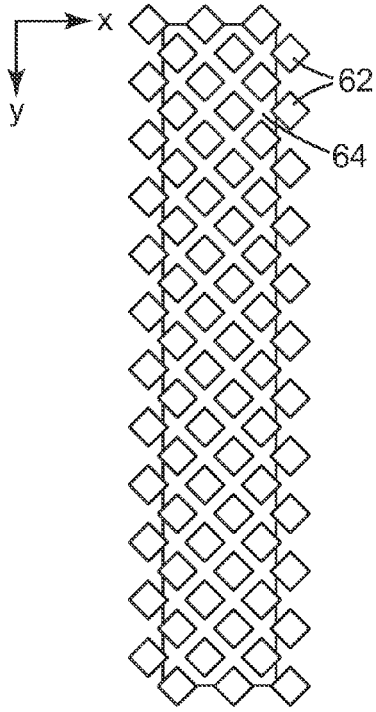
FIG. 6B shows an exemplary pattern of a continuous electroluminescent structure and discontinuous retroreflective segments configured in a two-dimensional array.
Figure 7A:
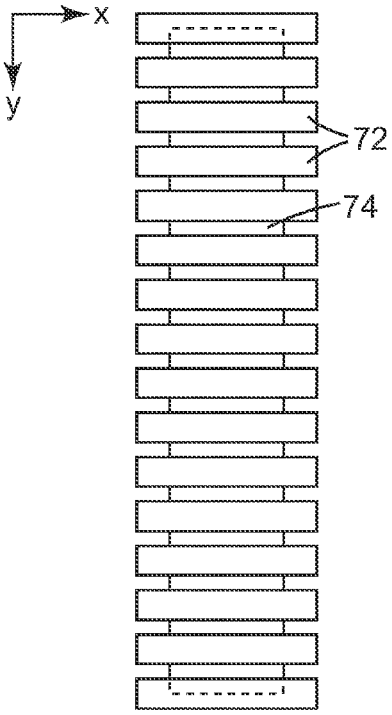
FIG. 7A shows an exemplary configuration of a continuous electroluminescent structure and discontinuous retroreflective segments configured in a one-dimensional array.
Figure 7B:
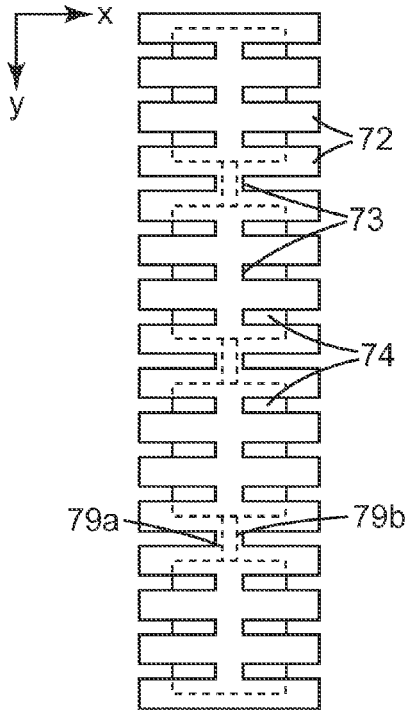
FIG. 7B shows an exemplary configuration of a continuous retroreflective structure and discontinuous electroluminescent structures.

Retroreflective structure 12 can be removably disposed on, adjacent to, or near the carrier film 11. Retroreflective structure 12 can be continuous or it can include a plurality of discontinuous structures, which can be arranged in a variety of patterns. Exemplary patterns include a linear array of stripes, as shown in FIG. 5, a two dimensional array, as shown in FIGS. 6A and 6B, a continuous or discontinuous configuration of horizontal bars as shown in FIGS. 7A and 7B, or any other appropriate configuration.

Retroreflective structure 12 can be made from a variety of materials by any suitable method. In one embodiment, retroreflective structure 12 can be purchased, for example, in the form of a transfer film, and attached to an electroluminescent structure 16, with a light-emitting side 13 of the electroluminescent structure 16 facing the retroreflective structure 12 and the reflective side 23 of the retroreflective structure 12 facing away from the electroluminescent structure 16. Retroreflective structure 12 and electroluminescent structures 16 can be attached to each other using, for example, adhesive, such as a heat activatable adhesive, pressure sensitive adhesive, or any other suitable commercially available adhesives. Commercially available products that are particularly suitable for use in embodiments of the present disclosure include transfer films with discontinuous retroreflective segments removably disposed on a carrier film, which are available from 3M Company, St. Paul, Minn., under the Scotchlite™ brand. More particularly, 3M Scotchlite™ Reflective Materials, 5500 series Comfort Trim products may be used (e.g., 5510 and 5530 Segmented Trims). The retroreflective structures in such products typically include a layer of beads embedded in a binder and often also include heat activatable adhesive. Such transfer films can be heat laminated to electroluminescent structure 16 through heat press lamination methods and the liner removed to expose the discontinuous retroreflective segments. Alternatively, electroluminescent structure 16 can be printed, coated, sewn or otherwise disposed on or attached to retroreflective structure 12.

Figure 1A:
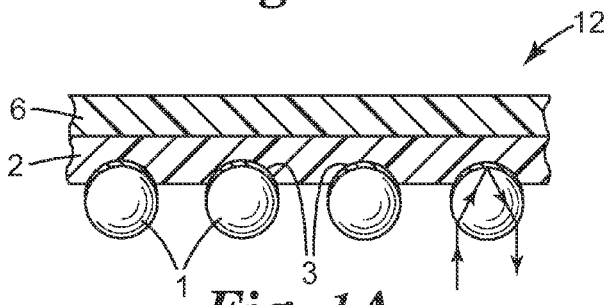

In other embodiments, retroreflective structures can be made by methods such as those described in WO 94/25666. As shown in FIG. 1A, glass beads 1 can be embedded into a bead carrier (e.g., carrier film 11, see FIG. 1). Specularly reflective materials 3 such as aluminum, silver, or cryolite can then be selectively vapor coated, screen printed, or otherwise disposed onto the exposed surface of the beads 1. A binder 2 can be coated or otherwise disposed on the vapor coated reflective layer 3, and a heat activatable adhesive 6 or another adhesion promoter can be provided. Optionally, a release liner can be adhered to the adhesive side to prevent adhesion during manufacturing or shipping. The bead carrier can be later removed to expose the beads and allow retroreflection.

Retroreflective structures 12 can also be made by plotter cutting a desired image or shape into a commercially available retroreflective tape, such as 3M™ Scotchlite™ reflective transfer film series 8700, or 3M™ Scotchlite™ reflective material 5807 series.

Retroreflective structures 12 can be disposed in any location relative to electroluminescent structures 16. For example, one or more retroreflective structures 12 can be disposed side by side with, adjacent to, and/or intermittently with electroluminescent structures 16. One or more retroreflective structures 12 can also be disposed at least partially in the light path of electroluminescent structures 16, covering the area of an electroluminescent structure that otherwise would be illuminated. For example, the retroreflective segments can be arranged as stripes across the electroluminescent structures as shown in FIGS. 2, 3, 4 and 5. Retroreflective structure 12 can overlap or intersect with electroluminescent structure 16 in any appropriate configuration so as to be at least partially in the light path of the structures as illustrated in FIG. 1.

Referring further to FIG. 1, retroreflective structure 12 can be at least partially in a path of light 15*a* capable of being emitted by the electroluminescent structure 16. For example the phosphor layer 164 emits light 15*a*, 15*b*. Because retroreflective segments of the retroreflective structure 12 are disposed in the light path of the electroluminescent article, emitted light 15*a* is blocked while emitted light 15*b* passes between the retroreflective segments and can be visible to a viewer when the carrier film 11 is removed from the laminate article 10 and the article is connected to a power supply.

Retroreflective structures 12 can also be configured so that they are not in a path of light capable of being emitted by an electroluminescent structure 16. For example, FIG. 6A shows some of the retroreflective segments 62 not in a path of light capable of being emitted by electroluminescent structures 64.

Figure 5A:
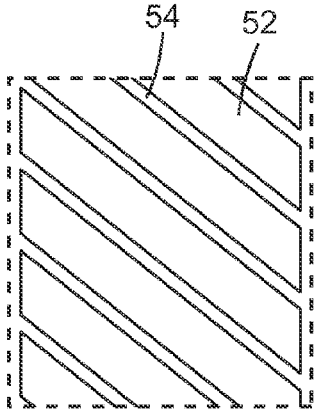

Retroreflective structures 12 can be a variety of shapes and can form a variety of patterns. For example, retroreflective structures 12 can be continuous as shown in FIG. 7B or can be discontinuous as shown in FIGS. 5, 6A, 6B and 7A. When retroreflective structures 12 are discontinuous, they can be arranged in any desired configuration and can be any desired shape, e.g., linear arrays such as a sequence of parallel stripes as shown in FIGS. 5 and 5A, a two dimensional array of generally diamond shapes, as shown in FIGS. 6A and 6B, or parallel bars as shown in FIG. 7A. Continuous retroreflective structures also may have a variety of configurations. These shapes and configurations listed above are only examples of the myriad of shapes and arrangements that can be used consistent with the present disclosure. Other shapes and configurations can easily be envisioned by those skilled in the art. A protective layer 14, electroluminescent structure 16, protective layer 17 and conductors 18*a* and *b* can be secured to retroreflective structure 12 and carrier film 11 by any appropriate method or means. For example, protective layer 14 can be printed, coated or laminated onto the electroluminescent structure 16 or can be attached directly to retroreflective structure 12. For example, layers 14, 16, 17, 19 and conductors 18*a* and 18*b* can be directly disposed over the retroreflective structure 12 and carrier film 11.

Alternatively, any combination of these layers can be disposed separately then secured to retroreflective structure 12 and carrier film 11 by any appropriate method including, but not limited to adhesive, e.g., heat activatable or pressure sensitive adhesive or lamination.

When layers 14, 16, 17, 19 and conductors 18 a and b are deposited over the carrier film 11 and retroreflective structure 12, the protective layer 14 can first be deposited, for example, coated or printed, above the retroreflective structure 12. The protective layer 14 can serve to seal/protect electroluminescent structure 16. When the laminate reflective and electroluminescent article is secured or attached to a garment or article, the orientation of the electroluminescent article is reversed so that the protective layer 14 covers the electroluminescent structure 16.

Protective layers 14 and 17 can be made of any suitable materials, such as polymeric materials, including a vinyl resin carrier, a urethane resin carrier (e.g., urethane acrylate) and other suitable materials, e.g., those listed in U.S. Pat. Nos. 5,856,029, 5,856,030, 6,696,786 and other suitable materials known to those of ordinary skill in the art to provide, for example, electrically insulating and/or environmentally protective capabilities.

Layers of the electroluminescent structure 16 can then be disposed over protective layer 14. An exemplary electroluminescent structure 16 can include a first electrode layer 162, a phosphor layer 164, a dielectric layer 166 and a second electrode layer 168. Additional layers can be added or dielectric layer 166 can be removed. An exemplary electroluminescent structure 16 can be made using a suitable unitary carrier, preferably capable of being deployed in gel form, such as a vinyl resin carrier, a urethane resin carrier (e.g., urethane acrylate) and other suitable materials. Exemplary materials suitable for use in the present disclosure are listed in U.S. Pat. Nos. 5,856,029, 5,856,030, 6,696,786, and 6,717,361. In some embodiments, the carrier can be UV curable and may include a catalyst. At least some or each layer can include the unitary carrier and some or all layers can also be doped with various additives. Such a carrier can be disposed on a wide variety of substrates, including metals, plastics, and cloth fabrics. Alternately, any other appropriate carrier could be used. Layers 162, 164, 166, 168 can be deposited by coating, printing, stacking or any other appropriate method.

In one embodiment, the electroluminescent structure 16, disposed over retroreflective structure 12, can be at least a partially, and, preferably, entirely monolithic. A monolithic structure can be created by suspending layers of electroluminescent structure 16 in a unitary common carrier. The layers can be disposed, for example, by printing them one on top of another. When all layers are disposed, the structure can be solidified, e.g. by curing, and the layers will become strata in a monolithic mass. Although in FIG. 1 the constituent components are shown as discrete layers and elements, all of the layers of the electroluminescent structure 16, such as the first electrode layer 162, phosphor layer 164, dielectric layer 166 and second electrode layer 168 can be part of a monolithic structure. In other exemplary embodiments, any two, three, four, or more adjacent layers could form a monolithic structure consistent with the present disclosure. Additionally, protective layers 14 and 17 can also be part of a monolithic structure.

Doping the various layers of the monolithic structure can be achieved by mixing appropriate amounts of dopants with any suitable carrier, as described above. Dopants and amounts can be, for example, similar to those discussed in U.S. Pat. Nos. 5,856,029, 5,856,030, 6,696,786, and 6,717,361, or can be determined by using other suitable methods. First electrode layer 162 can include the unitary carrier doped with a suitable translucent electrical conductor to allow light to be emitted through second electrode layer 162. For example, the dopant for first electrode layer 162 can include indium-tin-oxide (ITO) in powder form or any other appropriate dopant. First electrode layer 162 can have a thickness of about 5 microns or any other serviceable thickness.

Phosphor layer 164 can include the unitary carrier, such as vinyl gel resin, doped with electroluminescent grade encapsulated phosphor. An appropriate thickness for phosphor layer 464 can be 25 to 35 microns, or any other serviceable thickness. The color of light emitted by phosphor layer 164 is dependent on the choice of phosphor used in layer 164. A variety of colored dyes can be added to phosphor layer 164 to achieve a desired color of light, for example, blue, white, safety yellow or safety orange, but those knowledgeable in the art will also note that adding colored pigments or dyes in other layers, e.g., protective layer 14, could also achieve a similar effect. For example, rhodamine can be added to phosphor layer 164 to achieve the appearance of white light when the electroluminescent structure 16 is energized. Additional admixtures can be combined with phosphor layer 164 to improve the performance of electroluminescent layer 164. Dielectric layer 166 and phosphor layer 164 preferably overlaps electrode layer 162 to prevent electrical contact between first electrode layer 162 and second electrode layer 168.

Dielectric layer 166 can include the unitary carrier doped with a dielectric such as barium-titanate powder or any other appropriate dielectric in particulate form. Dielectric layer 166 can be deposited in multiple layers to prevent the possibility of any pinholes in the layer 166. Dielectric layer 166 can have a thickness of about 15 to 35 microns, for example, or any other serviceable thickness.

Second electrode layer 168 can include the unitary carrier doped with an ingredient to make the suspension electrically conductive. For example, silver or carbon in particulate form can be used as a dopant. Alternatively, gold, zinc, aluminum, graphite, copper, any combination thereof or any other appropriate ingredient may be used. The thickness of second electrode layer 168 can be, for example, about 8 to 12 microns or any other appropriate thickness to give serviceable results.

Exemplary weights of dopants and methods for mixing each respective layer consistent with the present disclosure are described, for example, in U.S. Pat. No. 6,551,726.

An electroluminescent structure as illustrated in FIG. 1 is not limited solely to the four layers depicted. Any number of layers resulting in a functional electroluminescent structure can be used. For example, other layers can be disposed in electroluminescent structures 16 for aesthetic or protective purposes. Electroluminescent structures 16 can also be a variety of shapes depending on intended use and/or other considerations.

Layers 162, 164, 166, 168 can be disposed using a variety of methods including coating or printing, e.g., silk-screen printing. When layers are screen printed, they can be printed in a series of intermediate layers to achieve a desired overall combined thickness. Layers can be cured, e.g., by exposure to ionizing radiation, such as heat or UV light or by any other appropriate method known to those skilled in the art.

Conductors 18*a*, 18*b* can be disposed between protective layer 17 and adhesive 19. Protective layer 17 can have openings 17*a* and 17*b*, which allow leads 162*a* and 168*a* of first electrode layer 162 and second electrode layer 168, respectively, to come into electrical contact with conductors 18*a* and 18*b*. Alternatively, conductors 18*a*, 18*b* can be disposed in any appropriate location, and other methods known to those of skill in the art can be used to electrically connect conductors 18*a* and 18*b* with electrode layers 162 and 168. If multiple electroluminescent structures are used, one or more conductive structures, such as one or more conductors 18*a*, 18*b* can electrically connect each electroluminescent structures to a power supply, in series or independently. Additionally, conductors 18*a*, 18*b* can electrically connect each electroluminescent structure to an inverter.

Conductors 18*a*, 18*b* can include conductive adhesive or wires, conductive yarns, strips of conductive material such as copper, a bus bar, printed circuit conductors or other suitable conductors. If conductors 18*a* and 18*b* are not insulated, additional insulation (not shown) may be provided as needed. The additional insulation may be in the form of one or more layers.

In one embodiment, conductors 18*a*, 18*b* include conductive adhesive. Conductive adhesive can be made of materials including polyester fibers (such as polyester terephthalate) or natural fibers, coated with conductive materials (such as one or more of copper, nickel and carbon). The fibers can be coated with a doped adhesive, such as acrylate adhesive, to provide conductive attachments. Conductors 18*a*, 18*b* can be made of commercially available conductive adhesives such as 3M™ CN 3190 Cu/Ni fabric tape, available from 3M Company. 3M™ CN 3190 Cu/Ni fabric tape includes anti-corrosion treated copper-nickel coated conductive polyester fabric and electrically conductive pressure-sensitive acrylic adhesive. Conductive adhesives can offer benefits such as flexibility and conformability, light weight and strength.

Adhesive 19, e.g., pressure sensitive adhesive, heat activatable adhesive or any other appropriate adhesive material, can be disposed over conductors 18*a*, 18*b*. Adhesive 19 can be used to secure the laminate reflective electroluminescent article 10 to a garment or any other appropriate item.

The present disclosure allows to make exemplary reflective laminate electroluminescent articles 10 that are flexible and, in some cases, at least somewhat stretchable. This is most often the case for at least partially monolithic constructions and constructions including an elastomeric material. For example, laminate reflective and electroluminescent articles 10 can be capable of being flexed or bent by a user under ordinary usage conditions. In some exemplary embodiments, the constituent layers of the laminate structure are sufficiently durable and flexible so as to be capable of being wound to form a rolled good. A typical rolled good according to the present disclosure is expected to be capable of being wound at least 20 times around a core having a diameter of 1 to 6 inches, preferably 2 inches.

In some embodiments, a laminate electroluminescent and reflective article can be characterized by a drape of no more than 400 g, preferably, no more than 300 g, more preferably, no more than 200 g, even more preferably no more than 100 g, and, most preferably, no more than 85 g. Drape may be measured as described in the Examples section below. The stretchability of an embodiment could be measured in terms of percent elongation prior to break by an Instron™ tensile tester. The Instron™ tensile tester has clamps to hold two ends of a sample, and will exert tensile force, pulling the ends of the sample farther apart until the sample breaks. An article that stretches further per amount of force applied has a lower modulus of elasticity and is generally more stretchable. In some embodiments, a laminate reflective and electroluminescent article can be characterized by a percent elongation of 50 percent or more, more preferably 60 percent or more, even more preferably 70 percent or more, and most preferably, 90 percent or more.

Figure 2:
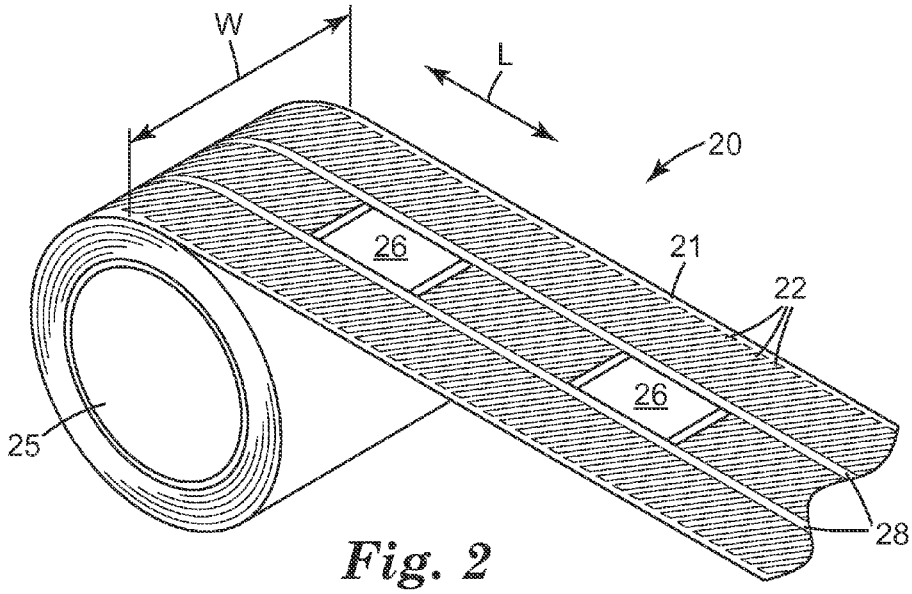
FIG. 2 shows an exemplary laminate reflective and electroluminescent article disposed in roll form.

FIG. 2 shows an exemplary laminate reflective and electroluminescent article 20 disposed in roll form. Exemplary laminate reflective and electroluminescent articles 20 can be created in a method similar to those described above. Retroreflective structures 22 can be disposed on carrier film 21. One or more electroluminescent structures 26 can be disposed, for example, in a linear array or any other appropriate pattern over the retroreflective structure. Conductors 28 can be disposed over the electroluminescent structures 26 so as to electrically connect the electroluminescent structures to each other and to a power source (not pictured). Adhesive can then be disposed over the electroluminescent article 20 and the entire article can be wound around a roll core 25. Alternatively, electroluminescent article 20 can be wound around itself to form a roll, or can be disposed in any other appropriate manner to form a roll. A roll form can have any appropriate diameter, and the roll form and electroluminescent article 20 can have any serviceable width and length. For example, an electroluminescent article 20 disposed in roll form may have a width W of ½ of an inch to 52 inches, preferably 2 inches, but other widths may be used that are less or more. An exemplary electroluminescent article 20 disposed in roll form may have a length L of 10 lineal meters or more, 25 lineal meters or more, 50 lineal meters or more, 100 lineal meters or more, or 200 lineal meters or more.

Figure 3:
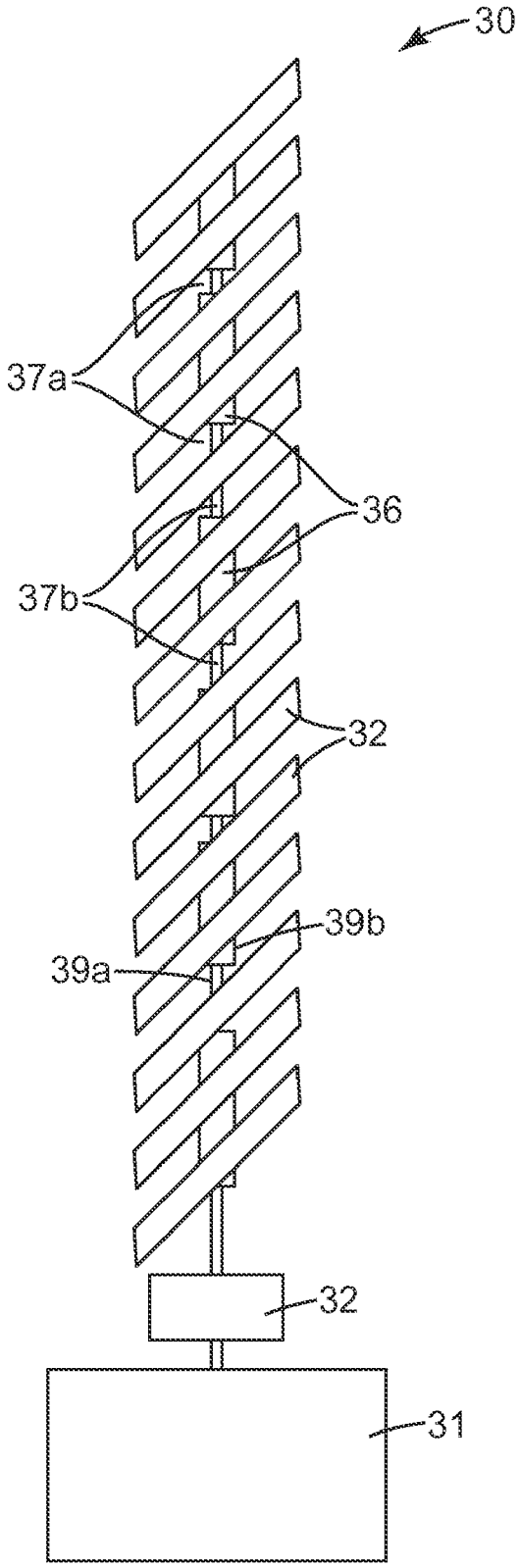
FIG. 3 shows a schematic diagram of an exemplary laminate reflective and electroluminescent article connected to a power source.

FIG. 3 shows a schematic diagram of an exemplary laminate reflective and electroluminescent article 30 connected to an inverter 32 and a power source 31. As illustrated in FIG. 3, conductors 39*a*, 39*b* can electrically connect a plurality of electroluminescent structures 36 to each other. Conductors 39*a*, 39*b* can also connect electroluminescent structures 36 to a power source 31. Optionally, conductors 39*a*, 39*b* may also connect the electroluminescent structures 36 to any other component, such as an inverter 32. The inverter 32 can convert DC power from the power source 31 to AC power for the electroluminescent structures 36. Alternatively, an AC power source can be used to provide power to the electroluminescent structures 36. Additional suitable circuitry and conductors (not pictured) can be included, e.g., to cause the lamps to flash at different rates, provide safety shutoffs for short circuits, or allow for optimized power usage.

In the illustrated embodiment, electroluminescent structures 36 can be discontinuous from each other, so that first gaps 37*a* are formed between adjacent electroluminescent structures 36. However, even in this embodiment, electroluminescent structures 36 are still connected by at least two discrete conductors, such as 39*a*, 39*b*, or a bus bar. The conductors 39*a* and 39*b* may be spaced apart from each other to provide second gaps 37*b*. Retroreflective segments 32 can be disposed over and at least partially in the light path of light capable of being emitted by the electroluminescent structures 36. Nonetheless, in the exemplified embodiment, the retroreflective segments do not completely cover the gaps 37*a* between electroluminescent structures 36 and/or the gaps 37*b* between the conductors 39*a* and 39*b*. Thus, when such exemplary laminate articles 30 include a carrier film (not shown), the gaps 37*a,b* comprise an exposed surface of the carrier film.

When, however, such exemplary laminate reflective and electroluminescent articles 30 are disposed on a support that is comprised in an end use article, such as a garment, the gaps 37*a,b* comprise an exposed surface of the support. Having such gaps can be very advantageous, especially if the support is porous, stretchable and/or flexible, because the presence of gaps is believed to improve vapor permeability, stretchability and/or flexibility of the combined laminate article 30 and the support (not shown), as compared to a similar construction without such gaps. Gaps can allow for increased moisture release, which is expected to increase perceived comfort of a laminate reflective and electroluminescent article 30 when disposed on a garment. Additionally, gaps can provide more locations for stress relief during wear and wash of a product, thereby increasing product durability and wash resistance.

Referring further to FIG. 3, the inverter 32, where used, and/or power source 31, can be disconnected from the electroluminescent assembly 30 for battery replacement, washing, or other reasons. In some exemplary embodiments, the inverter can be disposed in the same case as the power source.

Figure 4:
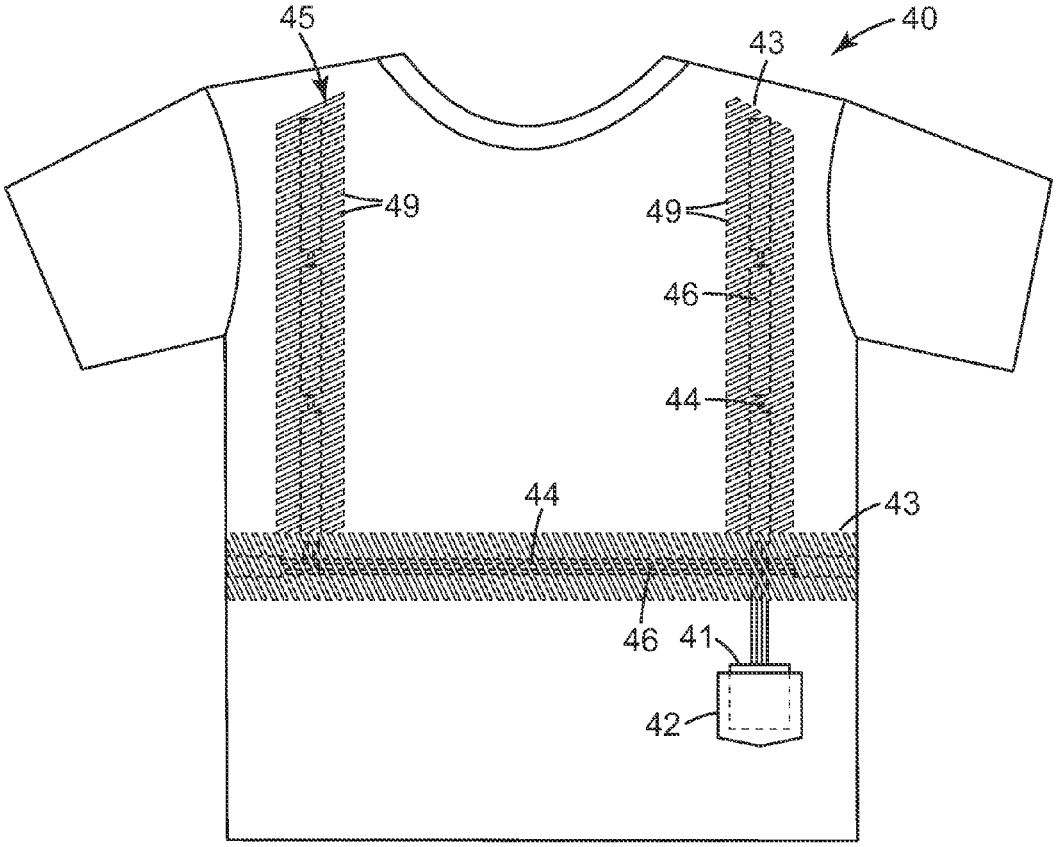
FIG. 4 shows an exemplary laminate reflective and electroluminescent article disposed on a garment.

FIG. 4 shows an exemplary laminate reflective and electroluminescent article 45 disposed on a garment (here, a shirt). A shirt 40 is only one example of the numerous garments and other articles that an electroluminescent assembly of the present disclosure could be disposed on or included in. For example, an electroluminescent assembly could be disposed on a vest, a jacket, pants, gloves, shoes, hats, or any other type of garment. Electroluminescent article 45 could alternately be disposed on or secured to any other type of article or structure, for example, a bag, bicycle, vehicle, sign, container, etc. by any appropriate means. Such a garment 40 or article can include a support 43, such as a garment shell, that the laminate reflective and electroluminescent article 45 can be disposed on. For example, a support can be made of fabric, woven material, nonwoven material, rubber, plastic, leather or any other appropriate material. A garment can optionally include a pocket 42 or other means for supporting the power source 41 and/or inverter. A means for supporting power source 41 can be at any suitable location.

An exemplary laminate reflective and electroluminescent article 45 disposed on a support 43 can include conductors 44 connecting electroluminescent structures 46 to each other and to a power source 41. Retroreflective segments 49 can of various shapes and can be configured in any appropriate layout. In the exemplary embodiment illustrated, discontinuous retroreflective segments 49 are disposed on the garment 40 to form right and left vertical sections that run up the front and down the back of the shirt 40. A horizontal section of discontinuous retroreflective segments can wrap around the torso of shirt 40, preferably about a user's waist area. Additionally, as discussed above, discontinuous retroreflective segments 49 can be configured in any way, for example, to meet the American National Standard for High-Visibility Safety Apparel ("the ANSI Standard") and other similar safety standards as described below.

Referring further to FIG. 4, one or more electroluminescent structures 46 may be disposed generally vertically (extending generally from the waist area toward the shoulder area of the wearer) on the right and left sides of the shirt 40 on both the front and back. Fewer or more electroluminescent structures 46 can be used on garments consistent with the present disclosure. In some exemplary embodiments, the garment 40 may also include one or more electroluminescent structures 46 disposed generally horizontally (extending generally around the torso of a wearer from the front side of the garment to the back side of the garment, in some cases curving about the wearer's body, such as to improve conspicuity of the garment when a wearer's side is turned to an observer).

A laminate reflective and electroluminescent article can be secured to a garment 40 by any appropriate means including, but not limited to, sewing the assembly to the garment, or securing the assembly to the garment with adhesive, such as pressure sensitive adhesive or heat activatable adhesive, or by any other appropriate method.

FIGS. 5 and 5A show an example of a pattern 50 of discontinuous retroreflective segments defining retroreflective 52 and non-retroreflective regions 54, which may be included in an exemplary retroreflective structure according to the present disclosure. In accordance with the present disclosure, the entire area of the non-reflective regions 54 or a portion of the area of the non-reflective regions 54 may be electroluminescent (i.e., emitting light due to electroluminescence of an underlying electroluminescent structure). In some exemplary embodiments, at least portions of at least some of the non-reflective regions 54 comprise gaps in the laminate structure, as explained above. When retroreflective regions 52 are arranged for safety garments, they can be designed to meet various safety standards. One such prominent standard is the ANSI Standard. The ANSI Standard dictates performance requirements for high visibility safety apparel, capable of signaling a user's presence in a conspicuously visible manner under any light conditions by day (this can be accomplished by use of fluorescent color) and under illumination by vehicle headlights in the dark (this can be accomplished by use of retroreflective materials). EN 471 is an example of a similar European standard, and many countries such as Australia, New Zealand, and Canada also have their own standards.

Retroreflective regions 52 can be configured to meet minimum reflectivity requirements. This can be achieved by ensuring that a minimum percentage of the total surface area defined by a pattern 50 (also shown in FIG. 5A) of discontinuous retroreflective segments, here, retroreflective regions 52, sufficient to achieve the appropriate coefficient of retroreflectivity based on the reflective properties of the retroreflective segments. For example, if non-retroreflective regions 54 account for 50 percent of the surface area of a pattern 50 of discontinuous retroreflective segments, the brightness would be approximately 50 percent less than it would be if retroreflective materials were applied in a continuous pattern. In the stripe-like pattern 50 shown in FIG. 5, the retroreflective regions 52 occupy approximately 66 percent of the surface area of pattern 50 and non-retroreflective regions occupy approximately 33 percent of pattern 50. Alternatively, retroreflective regions 52 can occupy at least 50 percent, 75 percent, 85 percent or any other appropriate percentage of a pattern 50 of discontinuous retroreflective segments. The general principle of designing the retroreflective pattern 50 is to maximize the total retroreflectivity of the retroreflective regions 52 while maintaining and maximizing the visibility of light from electroluminescent structures below the discontinuous retroreflective segments that is visible through the non-retroreflective regions 54.

Patterns 50 of discontinuous retroreflective segments consistent with the present disclosure can be designed to meet the ANSI Standard. For example, Table 5 of the ISEA document American National Standard for High-Visibility Safety Apparel (ANSI/ISEA 107-2004) shows a head-on initial minimum required value of 330 $R_a$. (measured in units of candelas per lux per square meter) and a head-on operable minimum required value of 100 $R_a$. In some exemplary embodiments, the electroluminescent assembly can be characterized by an initial head-on $R_a$ of 330 or more and an operable $R_a$. of 100 or more.

FIGS. 6A and 6B show examples of discontinuous generally diamond-shaped retroreflective segments 62, which may be included in an exemplary retroreflective structure according to the present disclosure. In such exemplary embodiments, the discontinuous retroreflective segments 62 are configured in a two-dimensional array, i.e., two or more discontinuous retroreflective segments are disposed along a first direction X and two or more discontinuous retroreflective segments are disposed along a second direction Y, which is different from the first direction. The first and second directions may be generally orthogonal to each other. Although generally diamond-shaped structures are illustrated, two-dimensional arrays may be formed from retroreflective segments having other shapes and sizes. Electroluminescent structures 64 can be continuous as shown in FIG. 6B or discontinuous as shown in FIG. 6A.

In the embodiment exemplified in FIG. 6A, the retroreflective segments 62 do not completely cover the gaps 67*a* between electroluminescent structures 64 and/or the gaps 67*b* between the conductors 69*a* and 69*b*. Due to the two-dimensional nature of the array of the retroreflective segments 62, in some exemplary embodiments, two or more gaps, 67*a*, 67*b* or a combination thereof, may be disposed along a first direction X. Additionally or alternatively, two or more gaps, 67*a*, 67*b* or a combination thereof, may be disposed along a second direction Y. Some advantages of a laminate article comprising gaps are explained above in connection with FIG. 3. Further advantages to having such gaps in a laminate article including a two-dimensional array of discontinuous retroreflective segments include potential further improvements in vapor permeability, stretchability and/or flexibility of the combined laminate article when it is disposed on a support, such as a thin breathable garment.

FIGS. 7A and 7B show examples of a continuous electroluminescent structure 74 with discontinuous retroreflective structures 72 (FIG. 7A) and discontinuous electroluminescent structures 74 with a continuous retroreflective structure 72, 73 (FIG. 7B).

FIG. 7A illustrates a linear array of retroreflective segments 72, in which only one retroreflective segment 72 is disposed along a first direction X, while two or more retroreflective structures are disposed along a second direction Y. FIG. 7B illustrates a continuous retroreflective structure, in which first retroreflective segments 72 are connected by second retroreflective segments 73. Because this exemplary embodiment includes discontinuous electroluminescent structures 74 which must be electrically connected (e.g., by conductors 79*a* and 79*b*), the second retroreflective segments 73 may be advantageously disposed over and cover one or more conductors 79*a*, 79*b*. In such exemplary embodiments, the second retroreflective segments 73 may be used to provide insulation for the conductors and/or protect the conductors form damage.

FIGS. 6A-7B are only a few examples of the numerous configurations of electroluminescent structures and retroreflective structures consistent with the present disclosure and are not intended to be limiting in any manner.

EXAMPLES

Historically, the use of electroluminescent lamps has required a stiff, multi-layered construction of electrodes and phosphors along with bulky and stiff crimps and bus bars. When such an assembly is applied to a garment, the garment is somewhat stiff and can be uncomfortable. BeaconWear™ vests made by Safe Lites, LLC of Eden Prarie, Minn., ("Traditional Construction") used for comparison with exemplary embodiments of the present disclosure, included traditional electroluminescent lamps extending vertically on the right and left sides of the front and back of the vest. Additionally, traditional electroluminescent lamps extended horizontally around the sides of the vest. A strip of retroreflective materials was attached to the vest to run parallel to each electroluminescent lamp, on each side of the lamp.

One way of characterizing comfort and flexibility of a fabric is to measure its drape. The drape of Traditional Construction was measured using ASTM D6828 test methods. This procedure uses a piece of equipment commonly known as a 'handle-o-meter' to measure the amount of force that is required to bend the sample under test. A stiffer material will require a higher force and a more flexible material (better drape) will require less force. Drape was measured in grams.

Three samples of Traditional Construction were cut from each of two constructions of the lamp and underlying assembly, namely, the vertical and horizontal lamp arrangements.

The composition and measured drape of each respective construction is shown in Table 1 below.

Drape for an exemplary embodiment of the current disclosure was also measured. Electroluminescent lamps were made as a monolithic construction such as one disclosed in U.S. Pat. Nos. 5,856,029, 5,856,030, 6,696,786, and 6,717,361. A retroreflective segment pattern similar to that shown in FIG. 6A was formed from Scotchlite™ 8725 series Silver Transfer Film to produce retroreflective segments, which were attached to the electroluminescent lamps, such that the reflective sides of the retroreflective segments faced away from the electroluminescent lamps. Strips cut from 3M™ CN 3190 Cu/Ni fabric tape were used to electrically connect electroluminescent lamps to each other and to a power source. The assembly was disposed on a fabric substrate and its drape was tested.

TABLE 1

Comparison of Drape

| | Traditional Construction in vertical assembly | Traditional Construction in horizontal assembly | Embodiment of Present Disclosure |
|---|---|---|---|
| Construction Components | 1. Typical electroluminescent lamp<br>2. Bus bar<br>3. Ribbon carrier<br>4. Fabric substrate | 1. Typical electroluminescent lamp<br>2. Bus bar<br>3. Fabric substrate | 1. Monolithic lamp<br>2. 3M ™ CN 3190 Cu/Ni fabric tape<br>3. 8725 Silver Transfer Film<br>4. Fabric substrate |
| Sample a | 970 g | 747 g | 87 g |
| Sample b | 970 g | 780 g | 83 g |
| Sample c | 922 g | 812 g | 83 g |
| Average | 954 g | 780 g | 85 g |

One can see that the embodiments of the present disclosure all possessed considerably better drape when compared to either the vertical or horizontal assembly of the Traditional Construction.

A traditional way of measuring the stretchability of a fabric or article is to use an Instron™ tensile tester to exert tensile force on the article until it breaks. An article that stretches further per amount of force applied has a lower modulus of elasticity and is generally more stretchable. A 0.5 inch sample of the Embodiment of the Present Disclosure as described above was tested using an Instron™ tensile tester to determine the percent elongation of each sample prior to breaking

TABLE 2

Stretchability Measurements

| | Embodiment of Present Disclosure |
|---|---|
| Construction Components | 1. Monolithic lamp<br>2. 3M ™ CN 3190 Cu/Ni fabric tape<br>3. 8725 Silver Transfer Film<br>4. Fabric substrate |
| Sample a | 59.71% |
| Sample b | 93.87% |
| Sample c | 58.43% |
| Average | 70.67% |

Once can see that embodiments consistent with the present disclosure can have an appreciable elongation indicating stretchability of the exemplary articles.

Positional terms used throughout the disclosure, e.g., over, under, above, etc., are intended to provide relative positional information; however, they are not intended to require adjacent disposition or to be limiting in any other manner. For example, when a layers or structure is said to be "disposed over" another layer or structure, this phrase is not intended to be limiting on the order in which the layers or structures are assembled but simply indicates the relative spatial relationship of the layers or structures being referred to. Furthermore, all numerical limitations shall be deemed to be modified by the term "about."

Although the present disclosure has been described with reference to preferred embodiments, those of skill in the art will recognize that changes made be made in form and detail without departing from the spirit and scope of the present disclosure.

What is claimed is:

1. A laminate electroluminescent and retroreflective article comprising:

an electroluminescent structure comprising an electrode layer, a phosphor layer disposed over the electrode layer and a transparent electrode layer disposed over the phosphor layer;

a retroreflective structure including a layer of glass beads and a specularly reflective agent disposed under the beads, the retroreflective structure having a head-on initial brightness of at least 330 candela per lux per square meter, the retroreflective structure comprising a plurality of discontinuous retroreflective segments; and a removable carrier film disposed over the retroreflective structure and the electroluminescent structure;

wherein a light-emitting side of the electroluminescent structure is positioned to face the retroreflective structure, and a reflective side of the retroreflective structure is positioned to face away from the electroluminescent structure.

2. The article of claim 1, wherein the retroreflective structure is disposed over the transparent electrode layer and at least partially in a path of light capable of being emitted by the electroluminescent structure.

3. The article of claim 1, wherein the retroreflective structure and the electroluminescent structure form a laminate structure.

4. The article of claim 1, wherein the electroluminescent structure and the retroreflective structure are laminated and together are characterized by a drape of less than 150 g.

5. The article of claim 1, wherein the electroluminescent article is capable of being wound in rolls of at least 10 lineal meters in length and at least ½ inch in width.

6. The article of claim 1, further comprising an adhesive disposed on a side of the electroluminescent structure that is opposite the retroreflective structure.

7. The article of claim 1, wherein at least a portion of the electroluminescent article has a unitary construction.

8. The article of claim 1, wherein the electroluminescent article comprises an elastomeric material.

9. The article of claim 1, wherein the beads of the retroreflective structures are at least partially embedded in a binder layer.

10. The article of claim 1, wherein the article is flexible.

11. A laminate electroluminescent and retroreflective article comprising:

a plurality of electroluminescent structures, each structure comprising an electrode layer, a phosphor layer disposed over the electrode layer and a transparent electrode layer disposed over the phosphor layer;

a retroreflective structure disposed over the plurality of electroluminescent structures and at least partially in a path of light capable of being emitted by the electroluminescent structures, the retroreflective structure including a layer of glass beads and a specularly reflective agent disposed under the beads, the retroreflective structure having a head-on initial brightness of at least 330 candela per lux per square meter, the retroreflective structure comprising a plurality of discontinuous retroreflective segments; and at least one connector comprising conductive adhesive, wherein at least one connector electrically connects at least two of the electroluminescent structures;

wherein a light-emitting side of each of the plurality of electroluminescent structures is positioned to face the retroreflective structure, and a reflective side of the retroreflective structure is positioned to face away from the plurality of electroluminescent structures.

12. The article of claim 11, further comprising a removable carrier film disposed over the retroreflective structure.

13. The article of claim 11, wherein the article is stretchable.

14. A laminate electroluminescent and retroreflective article comprising:

an electroluminescent structure comprising an electrode layer, a phosphor layer disposed over the electrode layer and a transparent electrode layer disposed over the phosphor layer; and a retroreflective structure including a layer of glass beads and a specularly reflective agent disposed under the beads, the retroreflective structure having a head-on initial brightness of at least 330 candela per lux per square meter, the retroreflective structure comprising a plurality of discontinuous retroreflective segments;

wherein the article is disposed in roll form; and wherein a light-emitting side of the electroluminescent structure is positioned to face the retroreflective structure, and a reflective side of the retroreflective structure is positioned to face away from the electroluminescent structure.

15. A laminate electroluminescent and retroreflective article comprising:

a plurality of electroluminescent structures, each structure comprising an electrode layer, a phosphor layer disposed over the electrode layer and a transparent electrode layer disposed over the phosphor layer;

a retroreflective structure including a layer of glass beads and a specularly reflective agent disposed under the beads, the retroreflective structure having a head-on initial brightness of at least 330 candela per lux per square meter, the retroreflective structure comprising a plurality of discontinuous retroreflective segments; and at least one connector electrically connecting at least two of the electroluminescent structures;

wherein at least two of the electroluminescent structures are discontinuous; and wherein a light-emitting side of each of the plurality of electroluminescent structures is positioned to face the retroreflective structure, and a reflective side of the retroreflective structure is positioned to face away from the plurality of electroluminescent structures.

16. A method of making a laminate electroluminescent and retroreflective article comprising:

providing a retroreflective structure attached to a removable carrier film, the retroreflective structure including a layer of glass beads and a specularly reflective agent disposed under the beads, the retroreflective structure having a head-on initial brightness of at least 330 candela per lux per square meter, the retroreflective structure comprising a plurality of discontinuous retroreflective segments; and disposing an electroluminescent structure, comprising an electrode layer, a phosphor layer disposed over the electrode layer and a transparent electrode layer disposed over the phosphor layer, on a side of the retroreflective structure that is opposite to the removable carrier film, such that a light-emitting side of the electroluminescent structure faces the retroreflective structure and a reflective side of the retroreflective structure faces away from the electroluminescent structure.

17. The method of claim 16, further comprising segmenting the retroreflective structure prior to the step of providing the retroreflective structure to form the plurality of discontinuous retroreflective segments.

18. The method of claim 16, wherein the step of disposing the electroluminescent structure comprises screen printing.

19. The method of claim 16, wherein the step of disposing the electroluminescent structure comprises disposing a first protective layer over the retroreflective structure, disposing a transparent electrode layer over the first protective layer, disposing a phosphor layer over the transparent electrode layer, disposing an electrode layer over the phosphor layer, and disposing a second protective layer over the electrode layer.

* * * * *

UNITED STATES PATENT AND TRADEMARK OFFICE

CERTIFICATE OF CORRECTION

PATENT NO. : 8,288,940 B2
APPLICATION NO. : 12/710628
DATED : October 16, 2012
INVENTOR(S) : Rodney K. Hehenberger It is certified that error appears in the above-identified patent and that said Letters Patent is hereby corrected as shown below:

Column 5
Line 51-59, Delete "A protective....film 11." and insert the same on Col. 5, Line 51, as a New Paragraph.
Line 60-64, Delete
"Alternatively, any... lamination." and insert the same on Col. 5, Line 59, after "film 11.", as a continuation of the same Paragraph.

Column 12
Line 21-35, Delete "FIG. 7A....damage." and insert the same on Col. 12, Line 20, after "(FIG. 7B).", as a continuation of the same Paragraph.
Line 48, Delete "Prarie," and insert -- Prairie, --, therefor.

Column 13
Line 46, Delete "breaking" and insert -- breaking. --, therefor.

Signed and Sealed this
Fifth Day of February, 2013

Teresa Stanek Rea
*Acting Director of the United States Patent and Trademark Office*